United States Patent [19]

Phillipson et al.

[11] Patent Number: 4,767,355

[45] Date of Patent: Aug. 30, 1988

[54] JACK AND CONNECTOR

[75] Inventors: Walter M. Phillipson, Woodside; Robert J. Brennan, Ossining; Terrence Meighen, Stormville, all of N.Y.

[73] Assignee: Stewart Stamping Corp., Yonkers, N.Y.

[21] Appl. No.: 911,445

[22] Filed: Sep. 25, 1986

Related U.S. Application Data

[60] Division of Ser. No. 655,696, Sep. 28, 1984, Pat. No. 4,653,837, which is a continuation-in-part of Ser. No. 612,722, May 21, 1984, Pat. No. 4,641,901, which is a continuation-in-part of Ser. No. 570,806, Jan. 16, 1984, Pat. No. 4,537,459.

[51] Int. Cl.[4] ..... H01R 13/648; H01R 4/24

[52] U.S. Cl. ..... 439/425; 439/610; 439/676

[58] Field of Search ..... 439/95, 98, 99, 108, 439/607, 608, 610, 444, 344, 425, 676

[56] References Cited

U.S. PATENT DOCUMENTS

| | | | |
|---|---|---|---|
| 4,516,825 | 5/1985 | Brennan et al. | 439/607 |
| 4,540,224 | 9/1985 | Maros | 439/99 |
| 4,566,745 | 1/1986 | Maros | 439/607 |
| 4,601,530 | 7/1986 | Coldren et al. | 439/460 |
| 4,618,202 | 10/1986 | Libregts et al. | 439/425 |

FOREIGN PATENT DOCUMENTS

| | | |
|---|---|---|
| 2523915 | 12/1976 | Fed. Rep. of Germany . |
| 975405 | 3/1951 | France . |

*Primary Examiner*—Gil Weidenfeld
*Assistant Examiner*—Gary F. Paumen
*Attorney, Agent, or Firm*—Steinberg & Raskin

[57] ABSTRACT

A jack adapted for connection to a printed circuit board or the like for a modular plug connector having a cord shield terminating contact includes a housing formed of plurality of jack parts adapted to interfit with each other to define an elongated receptacle for receiving the connector. One of the jack parts constitutes a grounding and shielding part formed of electrically conductive material and having top, bottom and side walls defining a closed, sleeve-like member. Each of the walls has a longitudinally extending inner surface at least a substantial portion of which bounds the plug receptacle so that a substantial portion of the receptacle is bounded on all of its sides by the electrically conductive material of the grounding and shielding part. The top, bottom and side walls of the grounding and shielding parts substantially surround the plug receiving receptacle on all of its sides substantially over its length. A modular plug connector adapted for insertion into the receptacle of the jack includes a housing which is surrounded by a conductive collar which terminates the cord shield through the side of the connector housing. The conductive collar is adapted to engage the inner surfaces of the grounding and shielding part of the jack which itself is grounded to thereby ground the shield.

23 Claims, 10 Drawing Sheets

JACK AND CONNECTOR

This is a division, of application Ser. No. 655,696, filed 9/28/84, now U.S. Pat. No. 4,653,837, which is a continuation-in-part of application Serial No. 612,722 filed May 21, 1984, now U.S. Pat. No. 4,641,901, which is a continuation-in-part of Application Ser. No. 570,806, filed Jan. 16, 1984, now U.S. Pat. No. 4,537,459.

BACKGROUND OF THE INVENTION

The present invention relates generally to electrical connectors and jacks and, more particularly, to a jack adapted to be connected to a printed circuit board and a modular plug connector designed for use therewith.

The termination of multi-conductor cord by modular plug connectors has become commonplace. Examples of such modular plug connectors are disclosed in various patents, such as U.S. Pat. Nos. 3,699,498, 3,761,869, 3,860,316 and 3,954,320. Another advantageous configuration of a modular plug connector is disclosed in U.S. Pat. No. 4,211,462 assigned to Stewart Stamping Corporation, assignee of the instant application. Essentially, the modular plug connector includes a dielectric housing having a cavity into which an end portion of the cord is received. Flat contact terminals corresponding in number to the number of cord conductors are inserted into respective slots which open at one housing side and which are aligned with the conductors so that blade-like portions of the contact terminals pierce respective cord conductors. Straight upper edges of the contact terminals are exposed at the side of the housing in position for engagement by respective jack contacts when the modular plug connector is inserted into the jack.

It is becoming more commonplace to couple the conductors of a multi-conductor cord to the conductors of a printed circuit board through the use of a modular plug connector. Accordingly, jacks for modular plug connectors have been designed specifically for connection to printed circuit boards.

Conventional jacks of this type, such as those available from Virginia Plastics Company of Roanoke, Virginia, generally comprise a one-piece plastic housing having a longitudinal cavity adapted to receive the modular plug connector. Associated with the housing are a plurality of jack contacts adapted to engage the straight edges of the contact terminals of the plug connector when the latter is inserted into the jack receptacle. Each jack contact is held by slots or grooves formed in the jack housing and includes a portion which extends along the rear housing wall and projects below the bottom of the jack housing for insertion into the printed circuit board and a portion which extends through a slot formed through the jack housing top wall into the jack receptacle for engagement with the edge of a respective contact terminal of the plug connector.

Jacks of this type are not entirely satisfactory for several reasons. For example, the jack contacts are exposed externally of the jack both at the rear as well as at the top wall thereof thus subjecting the contacts to possible damage during use. Moreover, portions of the jack contacts tend to be pushed out or become loosened from the slots or grooves which hold them in place.

Conventional jacks for modular plug connectors designed for connection to printed circuit boards are not completely satisfactory for another important reason.

Thus, digital-based electronic equipment is a major source of electromagnetic (EMI) and radio frequency (RFI) interference. Such interference has become a problem at least in part due to the movement away from metal and towards plastic as the material from which the plug connector housings are formed. Plastics generally lack the shielding capabilities which are inherent in metal housings.

In order to prevent or at least substantially reduce the emission of interference-causing electromagnetic and radio frequency radiation from multi-conductor cords used in digital-based electronic equipment and to provide at least some protection from interference-causing signals radiated from external equipment, cords have conventionally been provided with "shielding" in the form of a continuous sheath of conductive material between the outer insulation jacket of the cord and the insulated conductors, which sheath surrounds and encloses the conductors along their length. The shield can be formed of any suitable conductive material such, for example, as thin Mylar having a surface coated with aluminum foil or thin conductive filaments braided into a sheath construction. The shield acts to suppress or contain the interference-causing electromagnetic and radio frequency signals radiating outwardly from the cord conductors and, conversely, to prevent such high frequency signals generated by external equipment from causing interference in the conductors.

However, these techniques have not satisfactorily eliminated the interference problem and have created additional problems. Specifically, it has been found that there is still a tendency for EMI and RFI to result from the leakage of electromagnetic and radio frequency radiation signals from the cord in the region at which the modular plug connector is inserted into the jack receptacle. Moreover, it is not uncommon for high frequency signals radiated from nearby equipment to pass through the jack and cause interference in the cord conductors.

Furthermore, the radiation shield tends to acquire an electrostatic charge over a period of time and provisions therefore must be made to ground the shield. This has conventionally been accomplished either by means of a so-called "drain wire" which extends through the cord in electrical engagement with the conductive shield, the end of the drain wire passing out of the connector for connection to ground, or by grounding the shield through one of the modular plug connector contact terminals designed to engage a grounded jack contact upon insertion of the connector into the jack. However, when the radiation shield is grounded using such conventional techniques, it is not uncommon for deleterious electrical discharge arcs to occur across the connector contacts or across the printed circuit board conductors. Such arcing can cause serious damage to the electrical equipment.

The applicability of modular plug connections to digital-based electronic equipment, such as computers, has in the past been limited by the geometry of the electronic equipment and conventional plugs and jacks. Computers often include components consisting of a plurality of printed circuit boards stacked one over the other in closely spaced overlying relationship. For example, a computer may have printed circuit boards stacked one over the other with adjacent boards being spaced no more than one-half inch from each other. Since a typical printed circuit board has a thickness of about 0.060 inches and the pin portions of a jack connected to the board should protrude about 0.060 inches below the board bottom to permit effective soldering connections, an inter-board space of only about ⅜ inch would be available to accommodate a jack for receiving a plug connector. Indeed, this dimension may be even somewhat less where the jack is enclosed within an insulating sleeve to prevent electrical engagement with the jack pin portions protruding from the bottom of the next adjacent printed circuit board.

Since the height of conventional modular plug connectors is already about ⅜ths inch, the use of such connectors in environments of the type described above, keeping in mind the necessity of providing a jack for receiving the connector, is clearly not possible.

A modular plug connector and jack assembly is available from Amp Corp. under the designation Data Link wherein the outer surfaces of the plug receptacle entrance end of the jack is enclosed within a cap-like member of conductive sheet metal having contact projections which extend around the front of the jack and into the receptacle entrance. The cap-like member has pin portions adapted to be connected to ground through a printed circuit board. The connector housing is surrounded by a conductive collar which extends through the cord-receiving opening of the connector to terminate the cord shield. When the plug is inserted into the jack receptacle, the contact projections extending into the receptacle engage the shield terminating collar. This arrangement is not entirely satisfactory since the EMI/RFI shielding for the connector and the electrical engagement of the shield terminating collar of the connector to ground the same are not sufficient and reliable under all circumstances. Moreover, the location of the contact projections within the plug receptacle of the jack restricts the extent to which the profile of the jack can be reduced.

A jack for a modular plug connector adapted for connection to a printed circuit board is disclosed in applicant's copending application Ser. No. 612,722 filed May 21, 1984. Although the jack disclosed in said prior application provides effective shielding for the connector and grounding for shield-terminating structure of the connector, a more reliable shielding and grounding is always desired. Moreover, the jack disclosed in said prior application has a height which is too large to permit its use in the limited spaces described above.

SUMMARY OF THE INVENTION

Accordingly, it is an object of the present invention to provide new and improved jacks for modular plug connectors adapted for connection to printed circuit boards.

Another object of the present invention is to provide new and improved jacks for modular plug connectors adapted for connection to printed circuit boards which overcome the disadvantages of conventional jacks discussed above.

Still another object of the present invention is to provide new and improved low profile jacks for modular plug connectors which have a height of such small dimension as to permit connection to printed circuit boards which are stacked one over the other in closely spaced relationship to one another.

A further object of the present invention is to provide new and improved jacks for modular plug connectors which incorporate means for connecting shield terminating structure provided on the modular plug connectors to ground in a reliable manner.

A still further object of the present invention is to provide new and improved jacks for modular plug connectors which provide effective EMI/RFI shielding for the connector to attenuate any radiation passing into and out from the jack.

Another object of the present invention is to provide new and improved modular plug connectors adapted for use with jacks of the type described hereinabove.

Still another object of the present invention is to provide new and improved low profile modular plug connectors which have a height of such dimension as to permit use with jacks adapted for connection to printed circuit boards which are stacked one over the other in closely spaced relationship to one another.

A further object of the present invention is to provide new and improved modular plug connectors which incorporate means for reliably terminating the EMI/RFI shielding of a multi-conductor cord.

Briefly, in accordance with the present invention, these and other objects are attained by providing a jack for modular plug connectors designed for connection to a printed circuit board which includes a low profile housing formed of plurality of parts which when interfitted define an elongated cavity or receptacle for receiving a specially designed modular plug connector which terminates a multi-conductor cord. A plurality of jack contacts adapted to engage corresponding contact terminals of the modular plug connector are reliably held through the interfitting relationship of the various jack parts preferably such that the jack contacts are entirely enclosed within the housing except for the projecting pin portions thereof which are adapted to be inserted into the printed circuit board. The jack contacts are preferably shaped so as to present contact portions which ensure reliable engagement with corresponding connector contact terminals while having a reduced vertical extent to permit the jack to have a low profile.

One of the jack housing parts substantially surrounds the entire longitudinal extent of the modular plug connector when the latter is inserted into the plug receiving cavity and is formed of a material which is electrically conductive and which provides good EMI/RFI shielding to thereby attenuate any electromagnetic and radio frequency radiation passing out from or into the jack receptacle. At least substantial portions of the inner surfaces of the conductive jack part extend longitudinally from the entrance opening of the plug-receiving receptacle and bound the plug receptacle such that a substantial portion of the length of the receptacle is bounded on all of its sides by the electrically conductive material of the conductive jack part.

The jack further includes at least one ground contact which electrically engages the conductive jack housing part and which has a projecting pin portion for communication to ground through the printed circuit board.

A modular plug connector is provided with collar-like cord shield terminating means which substantially surround the exterior of the connector, the shield terminating collar having a portion which passes through the side of the modular plug connector to engage the cord shield. The shield terminating collar is adapted to electrically engage the inner surfaces of the conductive jack housing part which surrounds the connector and which bounds a substantial portion of the length of the plug-receiving receptacle upon insertion of the plug into the receptacle to thereby ground the shield through the ground contact described above. The other jack contacts are maintained electrically isolated from the conductive jack part at all times. Other details of the invention will be apparent from the following description.

DETAILED DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figures 1, 2:
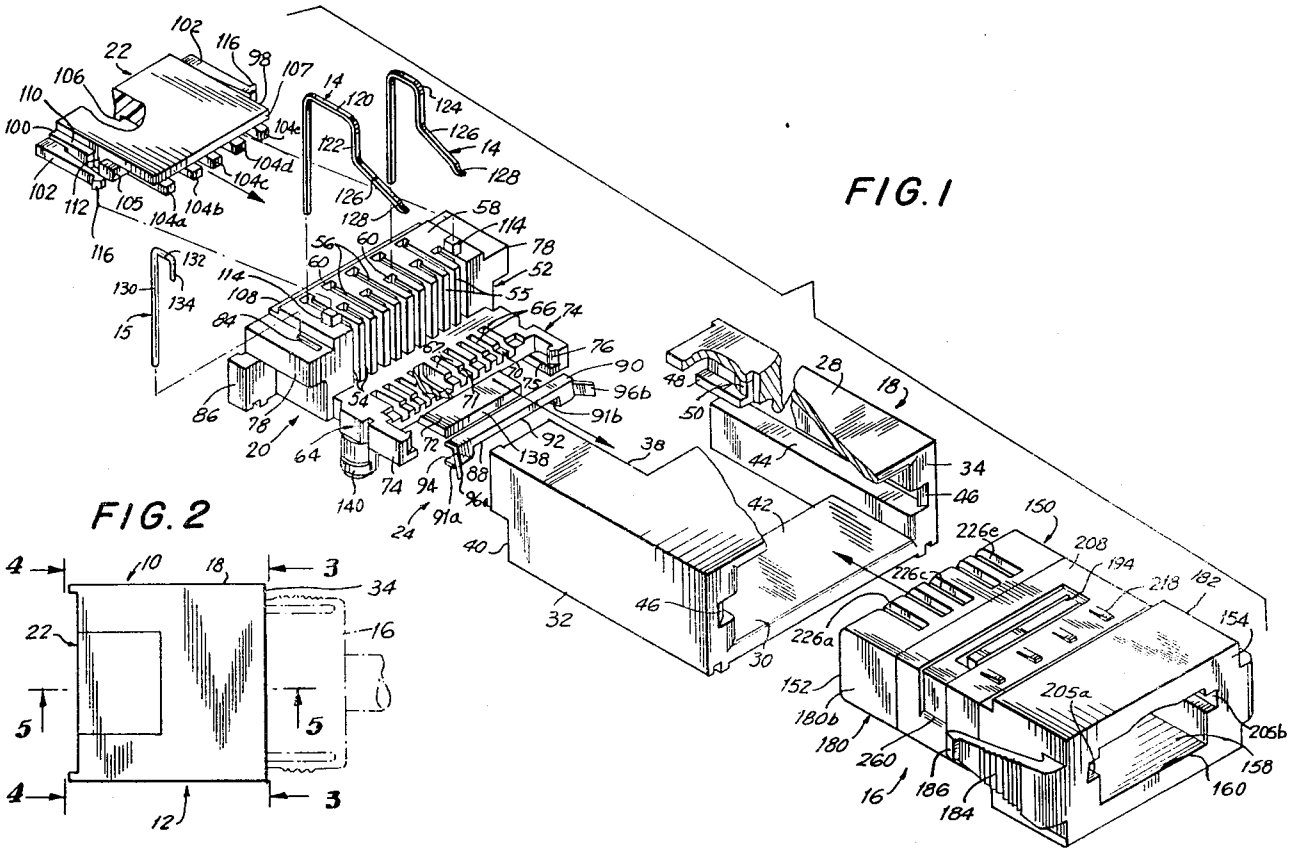
FIG. 1 is an exploded view in perspective of a jack and a modular plug connector in accordance with the present invention illustrating the manner in which the various components interfit.
FIG. 2 is a top plan view of the jack illustrated in FIG. 1 and showing in phantom the modular plug connector inserted therewithin.

Referring now to the drawings wherein like reference characters designate identical or corresponding parts throughout the several views and, more particularly, to FIGS. 1–6 wherein one embodiment of a jack in accordance with the present invention is illustrated, the jack, generally designated 10, comprises a housing 12 and a plurality of jack contacts 14 having pin portions 118 arranged in a pattern adapted to be received in corresponding receptacles of a socket in a printed circuit board, and contact portions 126 adapted to engage corresponding contact terminals of a modular plug connector 16 also constructed in accordance with the invention, an embodiment of which is best seen in FIGS. 1 and 7–11. The jack also accommodates ground contacts 15 which are adapted to engage and electrically ground a shielding and grounding part 18 of housing 12 which is formed of electrically conductive material.

The housing 12 is formed by an interlocked assembly of the shielding and grounding part 18, a contact guide part 20, a contact fixing part 22 and a contact stop part 24. When assembled, parts 18–24 constitute a jack housing 12 which securely holds the plurality of contacts 14 and 15 (except for their pin portions) entirely enclosed within the housing as described below and which defines an elongated receptacle or cavity 26 for receiving modular plug connector 16.

Figure 5:
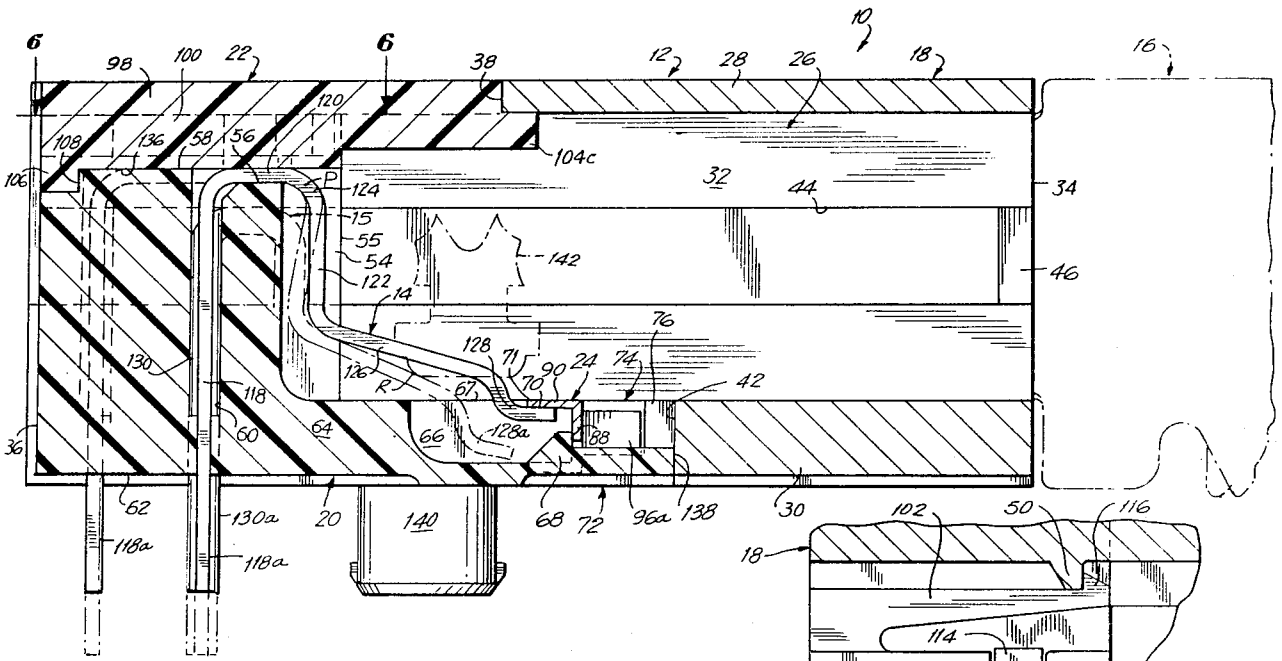
FIG. 5 is a longitudinal section view of the jack taken along line 5—5 of FIG. 2 and illustrating components of the modular plug connector in phantom.
Figure 6:
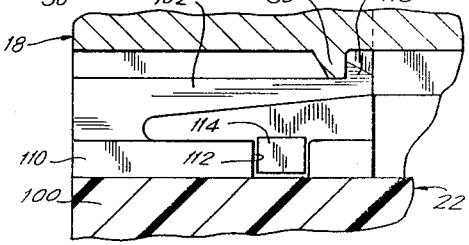
FIG. 6 is a partial section view taken along line 6—6 of FIG. 5.

The shielding and grounding part 18, best seen in FIGS. 1 and 3–5, is preferably molded of a material which is electrically conductive and which provides good EMI/RFI shielding, such as ABS with an aluminum flake filling or an alloy resin available from Mobay Chemical Corp. of Pittsburgh, Pennsylvania under the trademark Bayblend. Alternatively, part 18 can be manufactured of a metallic material, such as zinc, by die casting techniques. Part 18 has substantially rectangular, sleeve-like configuration including opposed top and bottom walls 28 and 30 and opposed side walls 32. The walls extend from a front surface 34 of part 18 which constitutes the front surface of jack housing 12. The top and side walls 28 and 32 extend to a rear surface 36 of part 18 which constitutes the rear surface of jack housing 12. A relatively large rectangular notch 38 is centrally formed in top wall 28 which extends from rear surface 36 for a length somewhat less than one half the length of part 18 while a smaller notch 40 is formed in the rear end of each of the side walls 32. Bottom wall 30 extends for a substantial distance and terminates at to a rear surface 42 situated at a substantially central region of a receptacle 26 as best seen in FIG. 5.

The front surface 34 of part 18 is rounded at each of the inner edges of the respective walls to define an entrance into the receptacle 26 for the modular plug connector. A pair of parallel inner channels 44 are formed in respective side walls 32, each of which opens at front and rear surfaces 34 and 36. A first locking portion 46 having a rearwardly facing locking surface is provided in each channel 44 at its front end for locking the modular plug connector within the jack.

Figure 3:
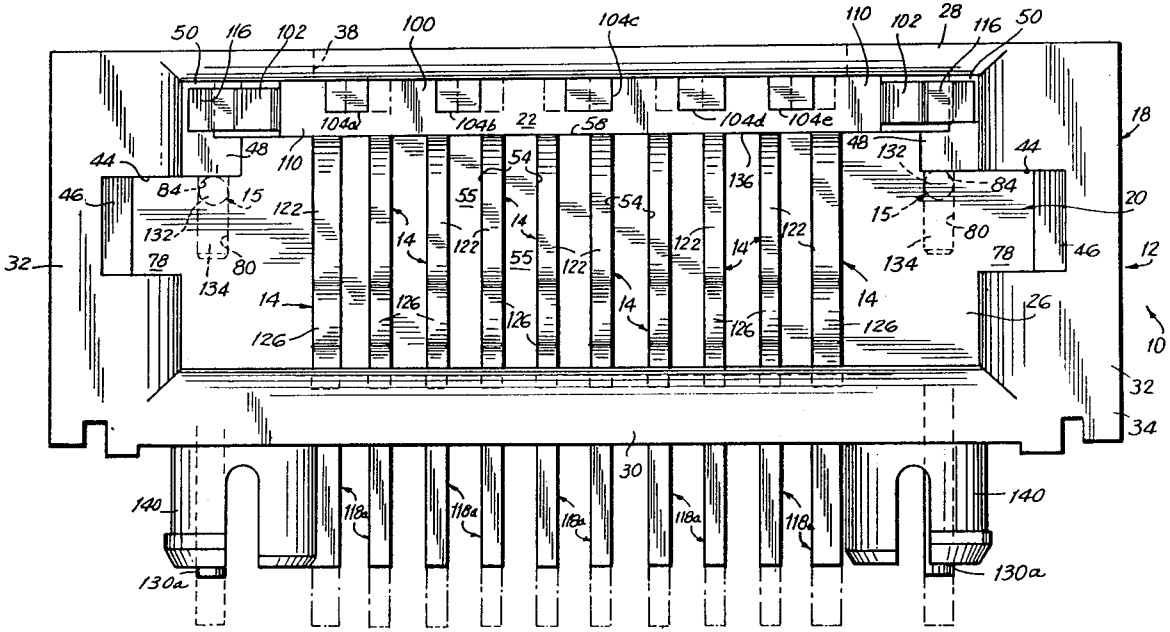
FIG. 3 is a front elevation view of the jack taken along line 3—3 of FIG. 2.
Figure 4:
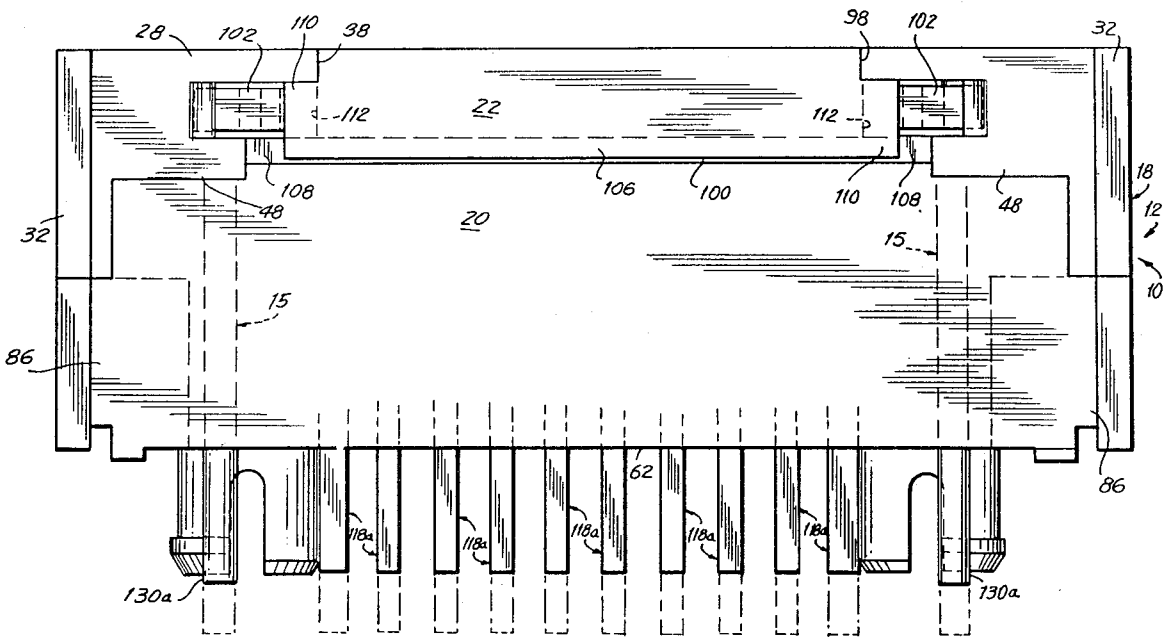
FIG. 4 is a rear elevation view of the jack taken along line 4—4 of FIG. 2.

A planar grounding portion 48 projects inwardly from each side wall 32 and extends forwardly from rear surface 36 a short distance. The downwardly facing surface of each grounding portion 48 is substantially coplanar with a downwardly facing surface of a respective channel 44 as best seen in FIG. 3 and is engaged by a respective one of the ground contacts 15 to electrically ground part 18 as described in greater detail below. A second locking portion 50 having a forwardly facing locking surface for locking an assembly of the parts 20 and 22 to part 18 projects inwardly from each side wall 32 and extends vertically between the forwardmost region of a respective grounding portion 48 and top wall 28.

Contact guide part 20, best seen in FIGS. 1 and 3–5, is molded of conventional dielectric plastic material and includes a block-shaped major portion 52, a shelf portion 64 projecting forwardly from the bottom of the front of major portion 52, a central platform portion 72 extending forwardly from the forward surface of shelf portion 64 and a pair of end retaining members 74 flanking platform portion 72. Each retaining member 74 has an upwardly facing support surface 75 and a vertical retaining portion 76.

A plurality of parallel, equally spaced vertical guide slots 54 are defined at the front of major portion 52 by a plurality of spaced, forwardly extending vertical walls 55. Each slot 54 communicates with the forward end of a respective horizontal groove 56 formed in the top surface 58 of the major portion 52 of part 20. The rear end of each groove 56 communicates with the top end of a respective vertical rectangular cross-section stepped bore 60 formed through part 20, the bottom end of which opens onto the lower surface 62 of part 20. Each of the bores 60 are alternately situated in one of two parallel, transverse planes which are longitudinally spaced from each other in accordance with the desired pattern of the pin portions of the jack contacts. Thus, the grooves 56 alternate in length as best seen in FIG. 1.

The shelf portion 64 has a plurality of horizontal guide slots 66 formed in its upper surface defined by a plurality of spaced forwardly extending vertical walls 67. Each guide slot 66 is aligned in a common plane with a respective one of the vertical guide slots 54 and the bottom wall of each slot 66 terminates at its forward end in a region 68 of increased thickness. A shallow recess 70 is formed in the upwardly facing surface of shelf portion 64 so that coplanar shoulders 71 are defined in walls 67 as best seen in FIGS. 1 and 5.

Each pair of aligned slots 54 and 66 and associated groove 56 and bore 60 serve to receive and position a respective jack contact 14 and guide the same upon engagement by a contact terminal of the modular plug connector as described below.

A horizontal rail 78 projects outwardly from each side surface of major portion 52 of contact guide part 20, the rails 78 adapted to be received in corresponding channels 44 of shielding and grounding part 18 during assembly of the jack as described below. Each rail 78 has a blind vertical bore 80 and a through-bore 82 formed therein, a groove 84 formed in a top surface of each rail 78 interconnecting the top end of each respective pair of bores 80 and 82. Each pair of bores 80 and 82 and associated groove 84 serve to receive and position a respective ground contact 15. A pair of flanges 86 project laterally from the rear end of the side surfaces of major portion 52 beyond the end surfaces of respective rails 78. A pair of guide projections 114 extend upwardly from the top surface 58 of part 20 for fixedly positioning part 22 with respective to part 20 during assembly of the jack. Posts 140 project downwardly from the lower surface 62 of part 20 which serve to mechanically affix the assembled jack to the printed circuit board.

Contact stop part 24, best seen in FIGS. 1 and 5, may be formed of either a dielectric material, such as plastic, or electrically conductive material, such as aluminum, depending on its intended function. In particular, stop part 24 in all cases functions to limit the movement of the jack contacts 14 as described below and, where desired, also functions to electrically short or ground the jack contacts upon removal of the modular plug connector from the jack receptacle in which case it is made of a conductive material. Contact stop part 24 has a channel-shaped construction including a web 88, an upper flange 90 and a lower flange 94. An elongated notch 92 is formed in lower flange 94 and part way through web 88 and has a length slightly greater than the transverse dimension of platform portion 72 of part 20 to define lower flange end portions 91*a* and 91*b*. A pair of ears 96*a* and 96*b* extend forwardly and outwardly from the respective edges of web 88.

Contact fixing part 22, best seen in FIGS. 1 and 3–5, is also molded of conventional dielectric plastic material and has a generally planar rectangular shape including an upper planar portion 98, a shorter and wider lower planar portion 100 integral therewith, a pair of latch members 102 joined to the respective side surfaces of the lower planar portion 100 and five elongate, keys 104*a*–104*e* which extend forwardly from the forward surface 105 of lower planar portion 100 a distance somewhat beyond the forward surface 107 of the upper planar portion 98. The upper planar portion 98 has transverse and longitudinal dimensions substantially equal to the corresponding dimensions of notch 38 formed in the top wall 28 of shielding and grounding part 18 and a thickness substantially equal to that of the top wall 28. The lower planar portion 100 has a length equal to the length of the top surface of the major portion 52 of contact guide part 20 so that, upon assembly, it overlies the vertical guide slots 54 as best seen in FIG. 5. A flange 106 depends downwardly from the rear end of the lower planar portion 100 which is adapted to interfit with a corresponding notch 108 formed at the rear end of major portion 52 of contact guide part 20. The lower planar portion 100 projects laterally beyond the upper planar portion 98 to define a pair of lateral extensions 110 in which openings 112 are formed adapted to align with and receive the guide projections 114 which extend upwardly from the top surface of the major portion 52 of contact guide part 20. Each latch member 102 includes an elongate portion which extends forwardly from the region at which it is joined to the respective lateral extensions 110 of the lower planar portion 100 and terminates at a locking portion 116 having a rearwardly facing surface which, upon assembly, is adapted to lockingly engage with the forwardly facing surface of the second locking portion 50 of the shielding and grounding part 18.

Referring to FIGS. 1, 3 and 5, the jack contacts 14 are preferably formed of suitable conductive material, such as phosphor bronze. In order to maintain a low profile for the jack, the contacts are preferably photoetched from relatively thin sheet material having a thickness, for example, of about 0.012 inches. As best seen in FIG. 5, each of the jack contacts 14 includes a pin portion 118, a bridging portion 120 extending at a right angle from pin portion 118, a rectilinear guide portion 122 connected to bridging portion 120 by a rounded pivot portion 124, a contact portion 126 forming an angle somewhat greater than 90° with guide portion 122 and a terminal stop portion 128. The pin portion 118 of each jack contact 14 has a length which is greater than the height of the major portion 52 of contact guide part 20 so that when the pin portion 118 is located within its respective bore 60, an end region thereof extends beyond the lower surface 62 to define a pin 118*a* adapted for insertion into the socket of the printed circuit board. The bridging portion 120 of each contact has a length which corresponds to the length of the groove 56 in which it is situated. Thus, the bridging portion 120 of the jack contacts 14 will have one of either a shorter or longer length depending upon in which of the two sets of vertical bores 60 the pin portion 118 is situated. The contact portion 126 of each jack contact 14 is formed so as to define an angle of about 15° with the horizontal when in its normal position as seen in FIG. 5 to comply with governmental regulations. Thus, contact portion 126 forms an angle of about 105° with guide portion 122. This angle may be within the range of between about 97° and 112°. Contact portion 126 is preferably coined during fabrication to further enhance electrical engagement with a respective contact terminal of the modular plug connector as described below.

Still referring to FIGS. 1, 3 and 5, the ground contacts 15 are formed of wire stock and include a pin portion 130, a bridging portion 132 and a fixing portion 134. The pin portion 130 is sufficiently long so that when it is located within vertical bore 80, an end region extends beyond the lower surface 62 to define a pin 130*a* adapted for insertion into a grounded socket of the printed circuit board. The bridging portion 132 is adapted to lie within groove 84 with a portion thereof extending slightly above the plane of the top surface of the respective rail 78 for engagement with conductive shielding and grounding part 18 as described below. The fixing portion 134 is captured within the blind bore 82.

Assembly of the jack 10 will now be described. The jack contacts 14 are first associated with contact guide part 20 by inserting their pin portions 118 through the tops of respective bores 60. The bridging and guide portions 120 and 122 of each contact are received in respective grooves 56 and vertical guide slots 54 respectively. The pin portions 130 of ground contacts 15 are similarly inserted through the bores 80 until their bridging and fixing portions 132 and 134 are received in grooves 84 and bores 82 respectively. As noted above, pins 118*a* and 130*a* thereby project below the lower surface 62 of part 20.

The contact fixing part 22 is then located over the top surface 58 of part 20 and is assembled thereto with guide projections 114 of the part 20 being received in the openings 112 formed in the lateral extensions 110 of part 22 to precisely position fixing part 22 with respect to guide part 20. As best seen in FIGS. 3 and 5, the downwardly facing bottom surface 136 of contact fixing part 22 lies flush against the top surface 58 of contact guide part 20 to close the grooves 56 and thereby capture the bridging portions 120 of jack contacts 14 in place.

The jack contacts are formed such that when positioned as described above in their unstressed state, the stop portion 128 of each contact is situated vertically over but not within a respective horizontal guide slot 66. In this connection the contact stop part 24 is then mounted to the assembly of the contact guide and fixing parts 20 and 22. Referring to FIGS. 1 and 5, the terminal stop portions of jack contacts 14 are urged or flexed into their respective slots 66 whereupon stop part 24 is positioned such that the end region of shelf portion 64 is received within the channel of part 24 with the upper flange 90 being situated in the shallow recess 70 abutting shoulder 71 to thereby overlie the end regions of the horizontal guide slots 66 and with the lower flange end portions 94*a* and 94*b* underlying the end region of shelf portions 64. The notch 92 which extends partially through the web 88 of stop part 24 provides a clearance through which the platform portion 72 extends. The stop part 24 is retained in position through the location of ears 96*a* and 96*b* in the lateral recesses defined by end retaining members 74. Thus, movement of the stop part 24 in the forward direction is prevented by engagement of the free edges of ears 96*a* and 96*b* with the rearwardly facing surfaces of retaining portions 76. By virtue of this construction, the terminal stop portions 128 of jack contacts 14 are captured and held within the horizontal guide slots 66 by the upper flange 90 of stop part 24 as seen in FIG. 5 with the contacts 14 being in a prestressed condition.

This assembly, consisting of the guide, fixing and stop parts 20,22 and 24 with the jack and ground contacts 14 and 15 located therein as described above, is then inserted into the shielding and grounding part 18 from the rear thereof as seen in FIG. 1. In particular, the rails 78 of part 20 are aligned with and inserted into respective channels 44 of part 18 and the assembly is urged forwardly until the forward facing surface 138 of platform portion 72 abuts against the rear surface 42 of bottom wall 30 of part 18. At the same time the locking portions 116 of latch members 102 move into locking engagement with the second locking portions 50 of part 18 to lock the assembly within the shielding and grounding part 18. The keys 104*a*–104*e* extend forwardly within the cavity 26 beneath the top wall 28 of part 18 as seen in FIGS. 3 and 5.

As noted above, the bottom surface of the planar grounding portions 48 of part 18 are coplanar with the downwardly facing surfaces of channels 44. Moreover, as best seen in FIG. 3, the upper surface of the portion of the rails 78 in which the grooves 84, which receive bridging portions 132 of ground contacts 15, are formed directly underlie and mate substantially flushly with the bottom surfaces of the respective planar grounding portions 48. As also noted above, the bridging portions 132 of ground contacts 15 protrude slightly beyond grooves 84 so that upon assembly the bridging portions 132 of the ground contacts engage the planar grounding portions of part 18 as best seen in FIG. 3. In this manner, the conductive shielding and grounding part 18 is electrically connected to ground contacts 15.

This completes the assembly of the jack 10. It is noted that jack and ground contact pins 118*a* and 130*a* project downwardly from the lower surface 62 of part 20 for insertion into an appropriate socket of a printed circuit board. The posts 140, integrally formed with part 20, extend downwardly to provide a rigid mechanical connection of the jack to the printed circuit board. The ground contact pins 130*a* are connected through the printed circuit board to ground to thereby connect the conductive shielding and grounding part 18 to ground. The two outermost jack contacts may be power transmitting contacts and therefore may be somewhat wider than the other jack contacts.

The construction described above advantageously permits the jack to have an unusually low profile while complying with requirements specified by governmental regulations and satisfying the other objectives of the invention as described below. Guidelines specify that the minimum height of a jack receptacle for a modular plug connector be about 0.260 inches and that the minimum height of the connector be about 0.255 inches. Given the design objective discussed above that the available space between adjacent printed circuit boards into which the jack must fit is about 0.375 inches, it is seen that the total height of the jack extending above and below the modular plug connector cannot exceed about 0.115 inches. To this end, the height of receptacle 26 of jack 10 is about 0.260 inches with the height or thickness of the top and bottom walls 28 and 30 part 18 being about 0.030 and 0.070 inches respectively. The height of the major portion 52 of part 20 is about 0.285 inches while the total height of part 22 including the upper and lower planar portions is about 0.085 inches.

In accordance with the invention the jack not only has such a low profile as to allow its use in the limited spaces described above but also provides extremely effective EMI/RFI shielding for the connector to attenuate any radiation passing into and out from the jack as well as reliable grounding for shield terminating structure provided on the modular plug connector. In particular the side walls 32 of the conductive shielding and grounding part 18 extend over the entire longitudinal extent of the receptacle 26. The top wall 28 of part 18 overlies the entire longitudinal extent of the top of receptacle 26 except for the portion of notch 38 and the bottom wall 30, although terminating at surface 42, extends over a substantial longitudinal extent of the bottom of receptacle 26. Thus, the walls of the conductive shielding and grounding part substantially surround the plug receiving receptacle on all of its sides substantially over its length thereby providing effective EMI/RFI shielding. Moreover, by virtue of the inner surfaces of the conductive shielding and grounding part 18 bounding a substantial portion of the length of the receptacle on all of its sides, a reliable electrical engagement between jack part 18 and a shield terminating collar surrounding a modular plug connector to ground the same as described below is assured. The height of the jack is defined by the distance between the outer surfaces of the top and bottom walls of the jack part 18 and can be maintained at a minimum.

The construction of the jack contacts is somewhat important in view of the low profile of the jack. As noted above, the jack contacts are formed of relatively thin conductive sheet material, such as 0.012 inches thick phosphor bronze sheet material, preferably by photoetching. However, it is important that each jack contact when mounted have sufficient resiliency so that when a modular plug connector is inserted into the jack receptacle and the contact portion of the jack contact is engaged by the edge of the flat contact terminal as described below, the jack contact will flex a sufficient amount so that a return force exists which urges the contact portion against the connector contact terminal with sufficient force to ensure a reliable electrical engagement. Additionally, sufficient room must be provided for depression of the stop portion 128 of the jack contact within the horizontal guide slots 66 to permit necessary movement between a normal position wherein the connector is not present in the jack receptacle and a flexed position wherein the modular plug connector has been inserted into the jack as shown in phantom and designated **128*a* in FIG. 5. Finally, the contact portion 126** of the jack contact should normally form an angle of about 15° with the horizontal in accordance with governmental specifications.

The construction of the jack contacts 14 in accordance with the invention satisfies these requirements. In particular, each jack contact 14 includes a rounded pivot portion 124 which subtends an angle of about 90°, the flexure of the jack contact effectively taking place around a point designated P in FIG. 5. As noted above, the contact portion 126 normally should form an angle of about 15° with the horizontal. It has also been found that in order to assure sufficient springback forces, i.e. sufficient resiliency to ensure a reliable electrical engagement between the jack and connector contacts, the distance between pivot point P and the point of engagement, designated R in FIG. 5, of the contact portion 126 and the flat contact terminal 142 should be in the range of between about 0.15 and 0.25 inches, most preferably about 0.20 inches. Within these parameters, the horizontal guide grooves 66 can have a depth of about 0.056 inches to allow sufficient room for movement of the contact stop portions 128 between their normal unflexed and flexed positions. This rather limited movement ensures adequate life for each jack contact. Moreover, the jack contacts are preferably situated within the contact guide part 20 in a pre-stressed condition as described above to further ensure a reliable electrical engagement with the contact terminals of the modular plug connector.

It is seen that except for the pins **118*a*, the jack contacts 14 are fully enclosed and rigidly supported within the jack housing 12 and are effectively electrically isolated from engagement with the shielding and grounding part 18 of the jack. The position and movement of the jack contacts are precisely controlled by guide slots 54 and 66**.

Referring to FIGS. 1 and 7–11, the construction of a modular plug connector in accordance with the invention will be described. The modular plug connector 16 is similar in several respects to the conventional connectors disclosed in the various patents mentioned hereinabove but differs in certain other respects. As in the case of conventional connectors, connector 16 includes a housing 150 formed as a rigid unipartite member of a suitable dielectric material by conventional injection molding techniques. The housing 150 has a closed forward free end 152, a cord-receiving rearward end 154 and a terminal-receiving side 156 for receiving flat contact terminals 142. The housing 150 defines a longitudinally extending cord-receiving cavity 158 which externally opens through a cord entrance opening 160 formed in the rearward end 154 of housing 150. The cord-receiving cavity 158 includes a forward conductor-receiving portion 162 and a rearward enlarged jacket-receiving portion 164. The cavity 158 substantially encloses the entire end section of the cord with the terminal end portions of the conductors (having the outer jacket stripped therefrom) being received in the conductor-receiving portion 162 and the adjacent jacketed portion of the cord being received within the jacket-receiving portion 164. The cord conductors 166 are precisely positioned within the conductor-receiving portion 162 in a manner described below so that they are in direct aligned relationship with respective ones of a plurality of parallely spaced, longitudinally extending terminal-receiving slots 168 formed through the terminal-receiving side 156 of the housing and which open onto the forward end 152 thereof so as to communicate with the conductor-receiving portion 162 of cavity 158. A pair of inwardly extending shoulders 170 and 172 are situated at about the mid-height of each slot 168.

Each contact terminal 142 is constructed of electrically conductive material, such as gold plated phosphor bronze, and includes a flat conductive portion having a pair of insulation-piercing tangs 174 and a pair of outwardly extending barbs 176 and 178. When a terminal 142 is inserted into a respective terminal-receiving slot 168, the tangs 174 penetrate through the insulation of a respective conductor 166 while barbs 176 and 178 become embedded within the inwardly extending shoulders 170 and 172.

Figure 10:
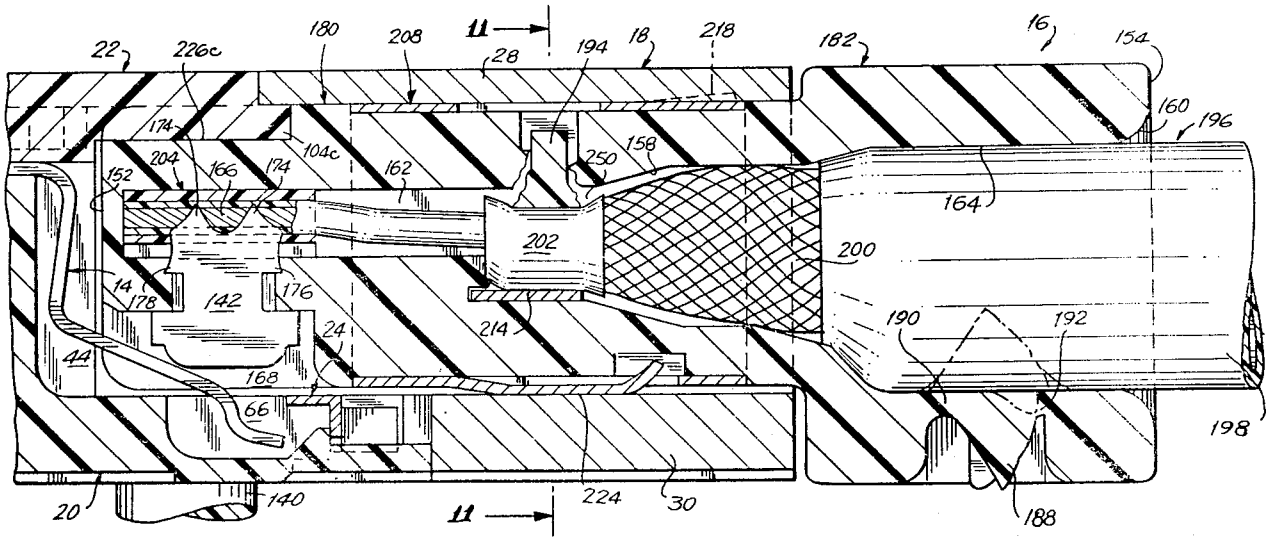
FIG. 10 is a longitudinal section view taken along line 10—10 of FIG. 9 and showing the termination of the cord in the modular plug connector and its cooperation with the jack.

In accordance with the invention, the housing 150 includes forward and rear sections 180 and 182, the forward section 180 having reduced dimensions corresponding to the dimensions of the jack receptacle 26 so as to be insertable therewithin. The rear section 182 has increased dimensions sufficient to accommodate the jacket-receiving portion 164 of the cord-receiving cavity 158 and is adapted to remain external of the jack receptacle 26 as best seen in FIG. 10. For example, the forward housing section 180 has a height of about 0.255 inches while the rear housing section 182 has a height of about 0.375 inches.

A pair of elongate latching members 184 are connected to the rearward ends of the lateral sides of the rear housing section 182 and extend forwardly to terminate at forward locking portions 186 having rearwardly facing locking surfaces which lie in a plane just forward of the intersection of the forward and rear housing sections. Upon insertion of the connector into the jack receptacle, the locking surfaces of the locking portions 186 engage the locking surfaces of the first locking portions 46 of the jack. By connecting the latching members 184 at the rearward end of the plug housing instead of the forward end as is conventional, the extent of flexure required by the latching members during insertion and locking of the connector in receptacle 26 is reduced and the possibility of fracture of the material connecting the latching members to the housing is correspondingly reduced.

The housing 150 includes means for securing the connector to the cord. In particular, a jacket anchoring member 188 is integrally formed within a well provided in the bottom wall of the rear housing section 182. Anchoring member 188 is connected to the housing section 182 along its forward edge by a plastic hinge 190 and along its rearward edge by a frangible portion 192 which supports the jacket anchoring member 188 when a cord is received within cavity 158. The frangible portion 192 is constructed so as to shear upon the application of an inwardly directed force so that the jacket anchoring member 188 pivots about hinge 190 to engage the cord jacket as shown by the dotted line configuration in FIG. 10.

Figure 8:
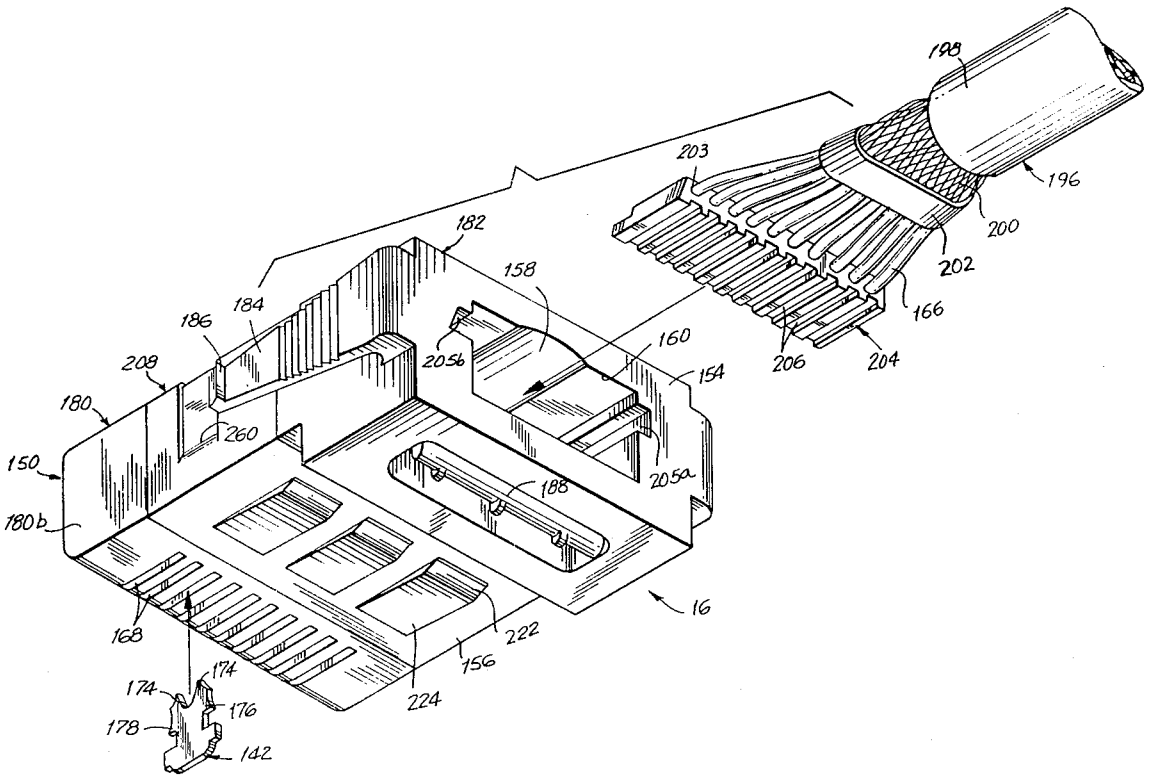
FIG. 8 is an exploded view in perspective of the modular plug connector and the end region of a cord provided with an assembly adapted to facilitate termination thereof in the connector.
Figure 9:
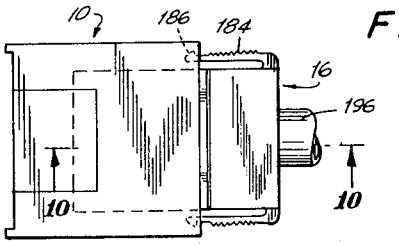
FIG. 9 is a top plan view of the jack and modular plug connector inserted therewithin.

The termination of a cord 196 to the connector 16 will now be described. Referring to FIGS. 8 and 10, in the illustrated embodiment, the cord comprises a multiconductor round cable comprising a plurality of insulated conductors 166. The conductors 166 are engaged within an outer jacket 198. A radiation shield 200 constituting a sleeve formed of braided conductive filaments is situated between the conductors 166 and the surrounding jacket 198 along substantially the entire length of cord 196. Prior to inserting the end of the cord into the cord-receiving cavity 158, a terminal length of the jacket 198 is stripped from the cord to expose the shield 200. A shorter terminal length of the shield 200 is then removed to expose end portions of the insulated conductors 166 while a short length of the shield 200 remains exposed. A ferrule 202 formed of thin conductive material is then crimped over the end region of the exposed portion of shield 200 so as to electrically engage the same over a full 360° of its circumference as best seen in FIG. 8.

The exposed ends of the insulated conductors 166 are inserted into respective parallel, longitudinally extending bores 203 formed in a plastic load block 204 (FIG. 8) which serves to facilitate positioning of the conductors 166 in the conductor-receiving portion 162 of cavity 158. In particular, the load block 204 has an outer substantially rectangular configuration adapted to be snugly received in the conductor-receiving portion 162 of plug cavity 158. Referring to FIGS. 1, 8 and 10, a pair of opposed side channels 205*a* and 205*b* are formed in cavity 158 extending along its entire length. The channels 205 are configured so as to provide sufficient space that the load block 204 can be received into the cord entrance opening 160 and pushed forwardly until it reaches its forwardmost position in the conductor-receiving portion 162 with its lateral ends supported in the respective channels 205. In its final position, the upper and lower surfaces of the load block substantially mate with the upper and lower surfaces of the conductor-receiving portion 162 and the forward end of the load block engages the inner surface of the forward closing wall of the plug so that the load block is snugly held in position.

The bores 203 are precisely formed in load block 204 so that when the load block is positioned within the conductor-receiving portion as described above, each bore 203 and, therefore, each conductor 166 inserted therewithin, is precisely aligned with a respective one of the terminal receiving slots 168. In order to guarantee that the load block is not inadvertently inserted into the plug housing upside down, the outer wall of one channel 205*b* is formed at a certain angle and one of the lateral sides of the load block is formed to slant at a corresponding angle. Thus, if it were attempted to insert load block 204 into the cavity in the incorrect orientation, the block would not fit into the respective channels Still referring to FIG. 8, a plurality of parallel, longitudinally extending channels 206 are formed in the surface of load block 204 which faces the terminal receiving slots 168 of connector 16. Each channel 206 is aligned with and directly overlies a corresponding bore 203. Accordingly, each channel will align with a respective one of the terminal receiving slots.

It will thus be seen that upon insertion as described above, the load block 204 serves to position each conductor 166 of cord 196 in precise alignment with a terminal receiving slot 168 of the modular plug connector. As each contact terminal 142 is driven into its respective slot 168, the tangs 174 thereof pass through a respective channel 206 in the load block and pierce a thin layer of plastic to enter a bore 203 to electrically engage the conductor 166 located therewithin in a solderless connection.

Figure 7:
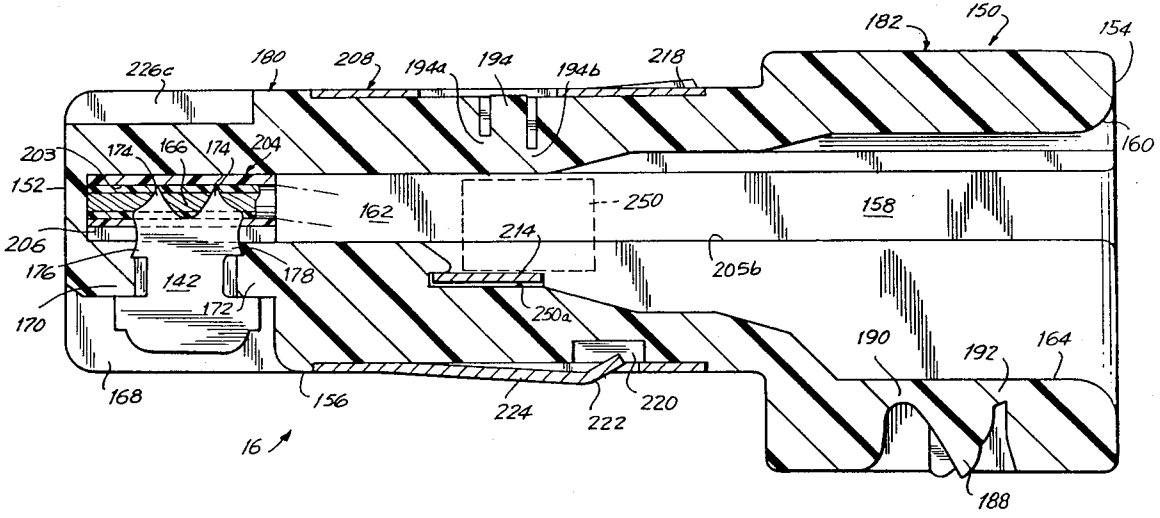
FIG. 7 is a longitudinal section view of the modular plug connector shown in FIG. 1.

In accordance with the invention the modular plug connector is provided with means for electrically terminating the interference shield 200. Referring to FIG. 7, the cord-receiving cavity 158 defines a shield-terminating portion 250, outlined in phantom, between the conductor-receiving portion 162 and the jacket-receiving portion 164. The cord 196 is terminated as described above in a manner such that the conductive ferrule 202 will be situated in the shield-terminating portion 250 of cavity 158 when the load block 204 with conductors 166 inserted in bores 203 is situated in its forwardmost position as seen in FIG. 10.

The upper wall of the forward section 180 of connector housing 150 has an elongate latch member 194 formed therein overlying and extending transversely over the substantial width of the shield-terminating portion 250 of the cord-receiving cavity 158. Latch member 194 is connected to the housing 150 by a pair of thinned webs 194*a* and 194*b* (FIG. 7) which are adapted to facture upon an inward driving force being applied to latch member 194.

Figure 11:
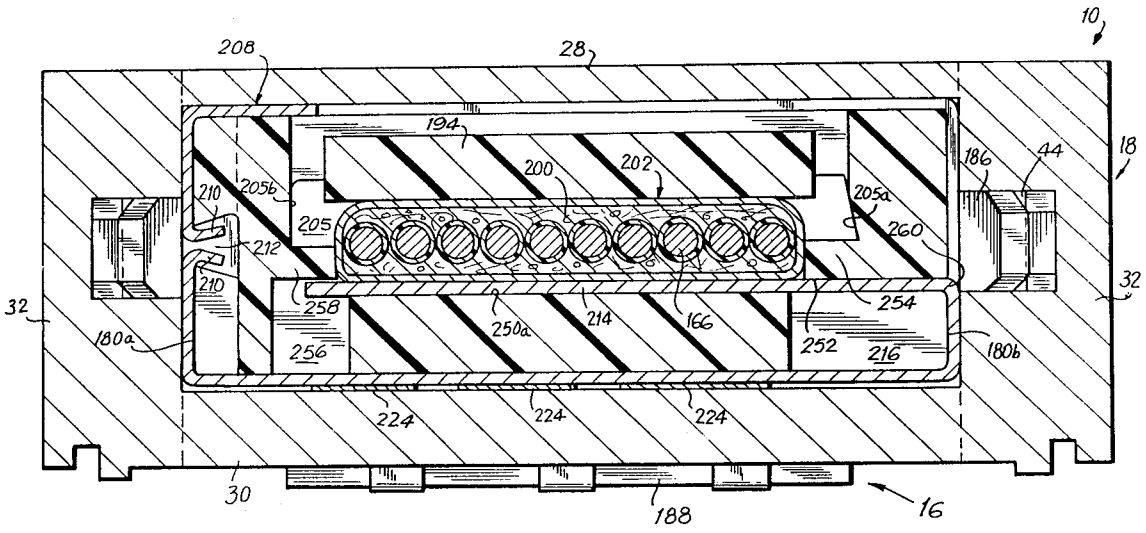
FIG. 11 is a transverse section view taken along line 11—11 of FIG. 10.

The forward housing section 180 of the plug 16 is encircled substantially around its entire circumference by a frame or collar 208 formed of a thin sheet of conductive material, such as a copper based nickel alloy. The conductive sheet material is pre-formed into the shape of a rectangular collar and then positioned over the housing section 180 so that the collar is received in a shallow recess formed in the outer surfaces therein. The transverse free end regions 210 of the conductive sheet are bent inwardly and captured within a slot or groove 212 formed in the side 180*a* of the housing section 180 as seen in FIG. 11.

Referring to FIGS. 1, 7, 8 and 11, a through-slot 252 is formed in the other side 180*b* of housing section 180 which communicates with the shield-terminating portion 250 of cavity 158. Through-slot 252 has a relatively short longitudinally extending width and is formed by molding the plug housing with a cutout 216 (FIG. 11) at the lower corner region thereof at side 180*b*, the cutout having a relatively short longitudinal extent and opening into the shield-terminating portion 250 to define a first shoulder 254. A second cutout 256 (FIG. 11) is formed in the housing section 180 extending upwardly from the bottom thereof adjacent side 180*a*, cutout 256 opening into the shield-terminating portion 250 at its transversely opposite side to define a second shoulder 258. The lower surfaces of shoulders 254 and 258 lie in a plane spaced a short distance from the plane of the bottom surface 250*a* of the shield-terminating portion 250 of cavity 158.

According to the invention, a portion of the conductive collar 208 extends into the shield-terminating portion 250 of cavity 158 in order to electrically engage the ferrule 202 which itself is in electrical engagement with the cord shield 200 throughout its circumference. In particular, a contact strip portion 214 is formed from collar 208 by severing the conductive sheet along a pair of parallel lines which extend transversely over the top surface of housing section 180 on either side of latch member 184 and which continue part way down the side 180*b* terminating in the region of through-slot 252 and a connecting end line. The strip portion 214 so formed is bent at fold line 260 and inserted into slot 252 as best seen in FIG. 11 so that it extends over the entire width of shield-terminating space 250 supported on its bottom surface 250*a*. The free end region of contact strip portion 214 is situated under shoulder 258 to fix the same in place. The part of the area of the collar 208 which is vacated by the contact strip portion 214 overlies the latch member 194 and provides access thereto during termination of the cord.

With the cord end prepared as described above and shown in FIG. 8, it is inserted into the cord-receiving cavity 158 so that the load block 204 is positioned at the forwardmost position of the conductor-receiving portion 162 of cavity 158. As noted above, the construction of the load block 204 is such that each conductor 166 is situated in aligned relationship with a respective terminal-receiving slot 168. At the same time, the conductive ferrule 202 which is in electrical engagement with the shield 200 over a full 360° is positioned within the shield-terminating portion 250 at a location directly beneath the latch member 194 and at the same time in electrical engagement with the contact strip portion 214 of collar 208. With the cord held in this position, the flat contact terminals 142 are inserted into slots 168 whereupon the tangs 174 of each terminal pierce through the material of the load block 204 and then through a respective conductor 166 to effect electrical engagement therewith. The jacket anchoring member 188 is driven downwardly to its locked position.

The latch member 194 is driven downwardly to the position illustrated in FIG. 10. The action of latch member 194 is two-fold, firstly compressing the underlying ferrule 202 onto the shield 200 and, secondly, urging the ferrule with a positive force against the contact strip portion 214. Thus, the 360° electrical engagement of the shield by the ferrule is further enhanced while at the same time providing a positive electrical coupling of the ferrule and the contact strip portion 214. In this manner, the conductive collar 208 which encircles the modular plug connector over a full 360° of its transverse circumference is electrically coupled to and terminates shield 200.

It should be noted that the use of a ferrule as described above is not absolutely essential and it is possible to effect electrical communication between the shield and the contact strip portion 214 in the absence of a ferrule.

In the manner described above, the modular plug connector is provided with means for terminating the EMI/RFI shield of a cord as a part of the connector itself so tbat electromagnetic and radio frequency interference-causing signals conducted through the shield can be conducted through the connector to be grounded through coupling with a grounded part of the jack as described below.

Referring to FIGS. 1, 7 and 8, a plurality (three shown) of leaf-spring portions 224 are integrally formed in the bottom side of collar 208 and a plurality of upwardly extending dimples 218 are formed in the top side thereof. Each of the leaf-spring portions 224 extend rearwardly and slightly outwardly and function to enhance the electrical engagement between the shield terminating collar 208 and the shielding and the inner surfaces of the top and bottom walls of the shielding and grounding part 18 of the jack upon insertion of the plug. Each of the first spring portions 224 terminates at an inwardly directed portion 222 which is disposed within a respective cavity 220 which provides clearance for flexing of the spring portion.

The modular plug connector 16 terminating the cord 196 as described above is inserted into the receptacle 26 of jack 10. As the connector 16 is moved forwardly a leading end of the outer edge of each flat contact terminal 142 engages the contact portion 126 of a respective jack contact 14 to effect electrical communication between the jack contacts and the respective conductors 166. The coining of the contact portions 126 of contacts 14 reduces abrasion during electrical engagement thereby approximating the characteristics of standard wire contacts such as are used in telephone jacks while at the same time permitting the contacts 14 to be formed of thin sheet metal stock to facilitate reduction in the height of the jack. Continued insertion of the plug causes the jack contacts 14 to flex from their rest positions (FIG. 5) to their flexed positions (shown in phantom in FIG. 5 and in FIG. 10) with reliable electrical engagement being maintained by virtue of the prestressing of contacts 14 described above. When insertion is completed, the locking portions 186 of latching members 184 engage the first locking portions 46 of the jack.

As seen in FIGS. 10 and 11, the outer surface of conductive collar 208 surrounding the modular plug connector engages and electrically communicates with the conductive shielding and grounding part 18 of the jack 10 when the connector is inserted within the jack receptacle. This electrical engagement is enhanced by the dimples 218 and leaf-spring portions 224 which are resilient and flex inwardly upon engagement with jack part 18 causing them to be continually urged with a positive force against the inner surfaces of the top and bottom walls of conductive jack part 18. The sides of collar 208 also at least partially engage the inner surfaces of the side walls of jack part 18. Thus, engagement between conductive jack part 18 and conductive collar 208 is effected substantially over 360° of the collar and opposed surfaces of the conductive jack part resulting in an extremely reliable electrical coupling therebetween.

It will be understood from the foregoing that the electromagnetic and radio frequency interference-causing signals and any electrostatic charge present in the shield 200 will be conducted through the modular plug connector by the contact strip portion 214 to collar 208 and then to the conductive shielding and grounding jack part 18. The electrical engagement between the collar 208 and the part 18 is enhanced by virtue of the construction described above wherein the collar surrounds the connector over substantially its entire circumference and engages the conductive jack part 18 substantially over its entire inner circumference.

The shielding and grounding part 18 is itself grounded through engagement of ground contacts 15 with the grounding portions 48 as described above. The ground contacts 15 are grounded through pins 130*a* which are inserted into grounded openings in the socket of the printed circuit board.

Various advantages are obtained by the construction described above. Firstly, a reliable grounding of the shield 200 is obtained. The fact that the shielding and grounding part 18 extends from the forward end of the jack substantially to its rearward end provides additional shielding for the modular plug connector as does the collar 208 which substantially surrounds the connector. The jack and modular plug connector have such low profiles as to permit connection to printed circuit boards which are stacked one over the other in closely spaced relationship.

Unlocking of the connector from the jack is accomplished by pressing the elongate latching members 184 inwardly to disengage the locking portions 186 from the first locking portions 46 of the jack whereupon the connector can be withdrawn from the jack receptacle. When desired, the contact stop part 24 may be formed of metallic conductive material so that upon withdrawal of the connector the stop portions 128 of jack contacts 14 engage the upper flange 90 of part 24 to ground any static charge which may remain on the contacts.

According to another feature of the invention, the jack is preferably provided with means for permitting selective use of only certain appropriate modular plug connectors therewith. In this connection, referring to FIG. 3, each of the five keys 104*a*–104*e* is formed in one of two positions, the alternate position of each key being laterally displaced from the one illustrated and shown in phantom in FIG. 3. This is easily accomplished through the provision and removal of appropriate inserts in the mold from which the contact fixing part 22 of the jack is formed. Referring to FIG. 1, the connector 16 is molded with corresponding keyways 226*a*–226*e*, each keyway 226 being appropriately situated so as to receive a corresponding one of the keys 104 as seen in FIG. 10. However, if one keyway 226 is not aligned with a corresponding key 104, it will not be possible for the connector 16 to be fully inserted into the jack and only connectors whose keyways fully match with the position of the keys 104 will be accepted within a particular jack. This provision advantageously prevents inadvertent connection of the wrong connector within a particular jack.

Figure 12:
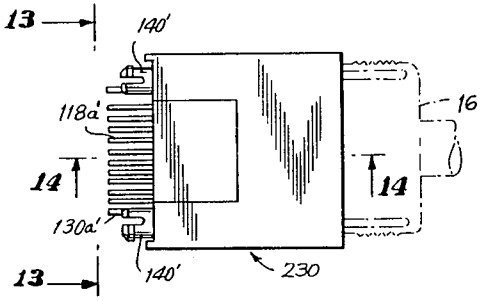
FIG. 12 is a top plan view of a second embodiment of a jack in accordance with the invention with the modular plug connector being illustrated in phantom.
Figure 13:
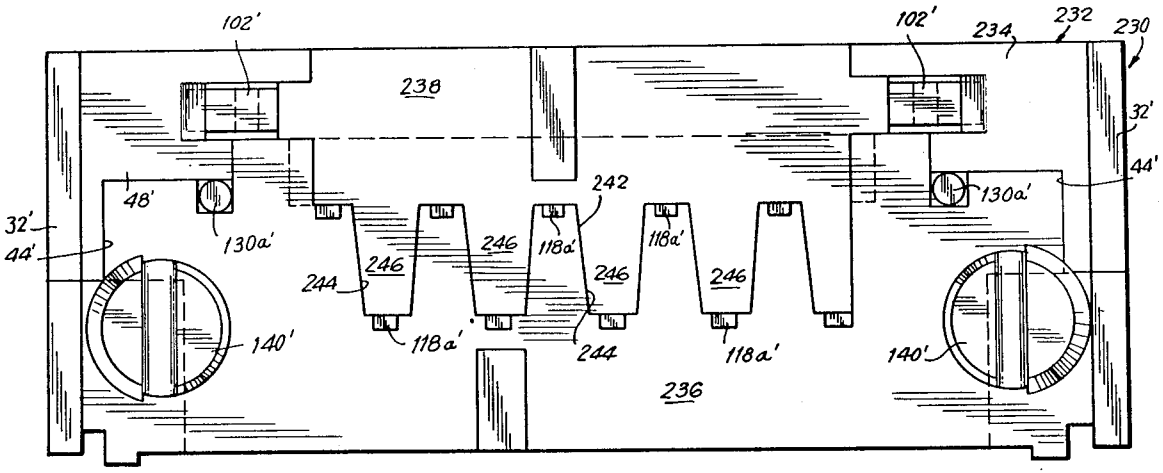
FIG. 13 is a rear elevational view of the jack taken along line 13—13 of FIG. 12.
Figure 14:
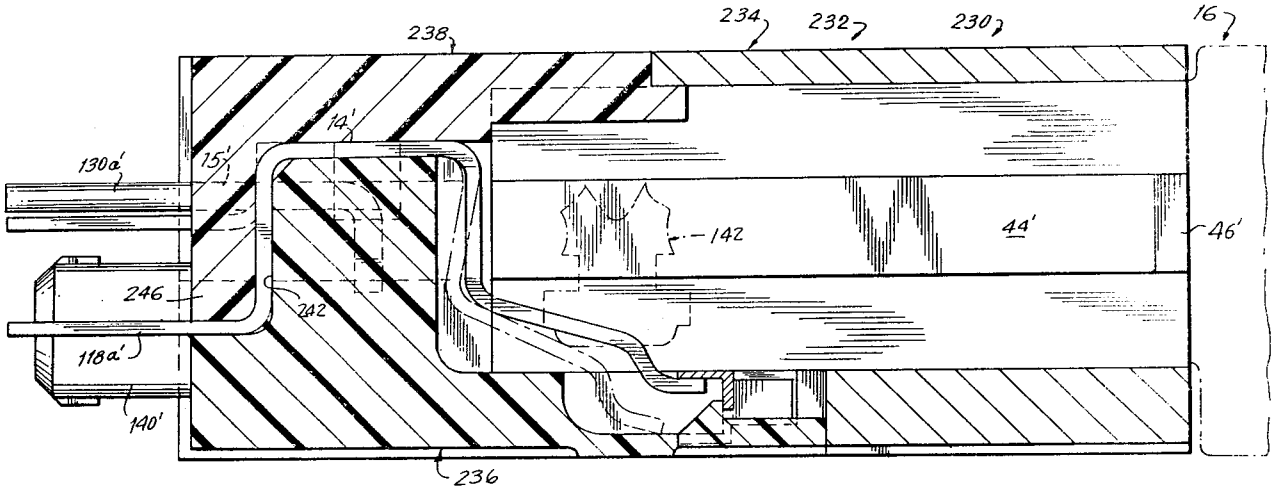
FIG. 14 is a longitudinal section view of the jack taken along line 14—14 of FIG. 12 and illustrating components of the modular plug connector in phantom.

Referring to FIGS. 12–14, a second embodiment of a jack in accordance with the present invention is illustrated. Jack 230 is adapted such that the contact pins extend from the rear surface of the jack and is used where the connector is to be inserted within the jack in a downward direction. Jack 230 includes a housing 232 formed of a plurality of parts which correspond to those which constitute jack housing 12, namely a shielding and grounding part 234, a contact guide part 236, a contact fixing part 238 and a contact stop part 240. The shielding and grounding part 234 is essentially identical to the shielding and grounding part 18 and is formed of a conductive material. The contact guide part 236 is similar to contact guide part 20 with the exception that a substantial recess 242 is formed in the rearward end portion thereof in which a plurality of vertical grooves of alternating lengths are formed. As seen in FIG. 12, the recess 242 includes a plurality of downwardly extending portions 244. The contact fixing part 238 is similar to the contact fixing part 22 but differs therefrom in that its rear end includes downwardly extending projections configured so as to mate with the recess 242 of the contact guide part 242. The cooperation of the alternating recesses 244 in the contact guide part 242 and the projections 246 of the contact fixing part define a series of passages through which portions of the jack contacts extend so as to exit from the jack housing at the rear face thereof. The various components of jack 230 which correspond to components of jack 10 are marked with corresponding reference numerals, primed.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A modular plug connector for terminating a shielded cord, the cord having a plurality of insulated conductors enclosed within an outer jacket and a conductive shield situated between the jacket and conductors and surrounding the latter, comprising: a dielectric housing having a top wall, an opposed terminal-receiving bottom wall and a pair of opposed side walls, said walls having respective outer surfaces, a forward free end and a rearward cord receiving end having a cord entrance opening formed therein opening into a cord-receiving cavity formed within the housing, said cord-receiving cavity having a forward conductor-receiving portion and a rearward jacket-receiving portion, a plurality of contact terminal-receiving slots formed in said terminal-receiving bottom wall communicating with said conductor-receiving portion of said cord-receiving cavity for receiving flat contact terminals adapted to electrically engage respective ones of the cord conductors; and shield terminating contact means for electrically engaging said cord shield and adapted to come into electrical engagement with a part of a jack formed of electrically conductive material upon insertion of the modular plug connector into the jack, said shield terminating contact means including a member formed of electrically conductive sheet material including an outer portion overlying a region of the outer surface of at least one of said top, bottom and side walls, and a contact portion integral with said outer portion extending into said cord-receiving cavity through opening means formed in one of said housing side walls.

2. The combination of claim 1 wherein said shield terminating contact means includes a collar-like member and wherein said outer portion includes top, bottom and side portions overlying regions of the outer surfaces of said housing top, bottom and side walls respectively to thereby surround the circumference of said housing.

3. The combination of claim 1 wherein said contact portion of said shield terminating contact means includes a contact strip portion extending through a slot formed in one of said housing side walls into said cord-receiving cavity, said strip portion being situated contiguous with a surface defining said cord-receiving cavity.

4. The combination of claim 1 wherein said outer portion of said shield terminating contact means is formed as a collar-like member with transverse free end regions thereof captured in a slot formed in one side wall of said housing and wherein said outer portion of said collar-like member includes top, bottom and side portions overlying regions of the outer surfaces of said housing top, bottom and side walls respectively to thereby surround the circumference of said housing, and wherein said contact portion of said shield terminating contact means includes a contact strip portion extending into said cord-receiving cavity through a slot formed in the other one of said housing side walls.

5. The combination of claim 1 further including substantially transversely extending latch means formed in one of said top and bottom walls of said housing at a location substantially aligned with the location in said cord-receiving cavity into which said contact portion of said shield terminating contact means extends, said latch means connected to said housing by frangible means to allow said latch means to be driven into said cord-receiving cavity.

6. The combination of claim 1 wherein said outer portion of said shield terminating contact means includes at least one of top and bottom portions overlying regions of the outer surfaces of said housing top and bottom walls respectively, and spring means formed in said outer portion for urging against said part of a jack formed of electrically conductive material upon insertion of the modular plug connector into the jack whereby electrical engagement between said shield terminating contact means in said jack part is reliably obtained.

7. The combination of claim 2 wherein leaf-spring means are formed in at least one of said top and bottom portions of said collar-like member, said leaf spring means including a rearwardly extending segment of said outer portion bent outwardly with respect to said outer portion.

8. The combination of claim 2 wherein outwardly projecting dimples are formed in at least one of said top and bottom portions of said collar-like member.

9. The combination of claim 1 wherein a pair of elongate latching members are integrally joined to said housing at the outer surfaces of respective ones of said side walls thereof, said latching members being joined to said side walls at locations adjacent to said rearward cord receiving end of said housing and extending forwardly toward said forward free end thereof.

10. A modular plug connector for terminating a cord having a plurality of insulated conductors and closed within an outer jacket, comprising:

a dielectric housing having a top wall, an opposed terminal-receiving bottom wall and a pair of opposed side walls, a forward free end and a rearward cord receiving end having a cord entrance opening formed therein opening into a cord-receiving cavity formed within the housing, said cord-receiving cavity having a forward conductor-receiving portion and a rearward jacket-receiving portion, a plurality of contact terminal-receiving slots formed in said terminal-receiving bottom wall communicating with said conductor-receiving portion of said cord-receiving cavity for receiving flat contact terminals adapted to electrically engage respective ones of the cord conductors; and a pair of opposed channels formed in said side walls of said housing, said channels opening into said cord-receiving cavity and extending continuously from the cord entrance opening through said conductor-receiving portion of said cavity.

11. The combination of claim 10 wherein the cross-section of one of said channels differs from the cross-section of the other one of said channels.

12. A modular plug connector terminating a shielded cord, comprising:

a cord having a plurality of insulated conductors enclosed within an outer jacket and a conductive shield situated between the jacket and conductors and surrounding the latter; a modular plug connector including a dielectric housing having a top wall, an opposed terminal-receiving bottom wall and a pair of opposed side walls, said walls having respective outer surfaces, a forward free end and a rearward cord-receiving end having a cord entrance opening formed therein opening into a cord-receiving cavity formed within the housing, said cord-receiving cavity having a forward conductor-receiving portion and a rearward jacket-receiving portion; an end portion of said cord having the jacket removed therefrom to expose a portion of said conductive shield and said conductors; said cord end portion inserted within said cord-receiving cavity; a plurality of flat contact terminals received in a corresponding plurality of contact terminal-receiving slots formed in said terminal-receiving bottom wall, each of said flat contact terminals electrically engaging a respective one of said cord conductors in said conductor-receiving portion of said housing; said exposed portion of said conductive shield being situated in a shield terminating portion of said cord-receiving cavity; and shield terminating contact mean for electrically engaging said exposed portion of said conductive shield and adapted to come into electrical engagement with a part of a jack formed of electrically conductive material upon insertion of the modular plug connector into the jacks, said shield terminating contact means including a member formed of electrically conductive sheet material including an outer portion overlying a region of the outer surface of at least one of said top, bottom and side walls, and a contact strip portion integral with said outer portion extending into said shield-terminating portion of said cord-receiving cavity through opening means formed in one of said housing side walls.

13. The combination of claim 12 wherein said shield terminating contact means includes a collar-like member and wherein said outer portion includes top, bottom and side portions overlying regions of the outer surfaces of said housing top, bottom and side walls respectively to thereby surround the circumference of said housing; and wherein said contact portion of said shield terminating contact means includes a contact strip portion extending through a slot formed in one of said housing side walls into said cord-receiving cavity, said strip portion being situated contiguous with a surface defining said shield terminating portion of said cord-receiving cavity.

14. The combination of claim 13 further including substantially transversely extending latch means formed in one of said top and bottom walls of said housing at a location substantially aligned with said shield terminating portion of said cord-receiving cavity, said latch means connected to said housing by frangible means to allow said latch means to be driven into said cord-receiving cavity.

15. The combination of claim 12 wherein a deformable ferrule formed of conductive material surrounds said exposed portion of said conductor shield and is electrically engaged by said contact strip portion.

16. A cord assembly terminated by a modular plug connector, the modular plug connector including a dielectric housing having a terminal-receiving bottom wall, and top and side walls, said walls defining a forward free housing end, a rearward cord-receiving housing end having a cord entrance opening formed therein, and a cord-receiving cavity having a forward conductor-receiving portion, and terminal-receiving slots formed in the housing bottom wall communicating with said conductor-receiving portion of said cord-receiving cavity, said terminated cord assembly further comprising:

a plurality of insulated conductors enclosed within an outer jacket, an end portion of said cord having said outer jacket removed therefrom to expose end regions of said insulated conductors; and a load block having a plurality of means for holding said end regions of said conductors in mutually parallel relationship and mutually spaced from each other by a distance equal to the distance between the terminal-receiving slots formed in said housing, and wherein at least a part of said load block with said end regions of said conductors held therein extends into said forward conductor-receiving portion of said cord-receiving cavity which communicates with said terminal-receiving slots.

17. The combination of claim 16 wherein said load block includes a pair of opposed transverse edge regions, one transverse edge region of said load block having a configuration which differs from that of the other transverse edge region.

18. The combination of claim 16 wherein said plurality of means for holding said end regions of said conductors in mutually parallel relationship comprise a plurality of parallel bores formed through said load block, each bore receiving an end region of a respective conductor.

19. The combination of claim 18 wherein a plurality of parallel channels are formed in said load block, each channel being aligned with a respective one of said conductor receiving bores.

20. An electrical connector comprising an insulating housing having a wire receiving duct extending rearwardly from a location adjacent a contact face and opening at a wire receiving mouth at a rear face; a row of closely spaced contact receiving cavities at the contact face communicating with the wire receiving duct at the location; a wire holder having a row of wire locating apertures at the same pitch as the cavities; a series of discrete wires extending from a bundle of wires, said wires including respective end regions loaded in the respective wire locating apertures of the wire holder so that said end regions of the discrete wires are located at the same pitch as the cavities; the wire holder loaded with the end regions of said wires being inserted in the duct so that at least a portion thereof is situated at the location adjacent the contact face communicating with said contact receiving cavities and so that said end regions of the discrete wires are aligned with respective cavities and a row of contacts received in respective cavities in terminating engagement with respective end regions of said wires held in said wire holder.

21. A method of assembling and terminating discrete wires extending from a bundle of wires in an electrical connector of the type comprising an insulating housing having a wire receiving duct extending rearwardly from a location adjacent a contact face and opening at a wire receiving mouth at a rear face; a row of closely spaced contact receiving cavities at the contact face communicating with the duct at the location; and, a row of contacts received in respective cavities, the method comprising the steps of providing a wire holder having a row of apertures at the same pitch as the cavities; loading end regions of the discrete wires into respective said apertures to form a subassembly with the end regions of the wires located at the same pitch as the row of cavities; inserting the subassembly through the mouth into and forwardly along the duct so that at least a portion of said subassembly is situated at the location adjacent the contact face communicating with said contact receiving cavities to bring the individual end regions of the wires into alignment with respective contacts and drawing the contacts into terminating engagement with the end regions of the wires held in said wire holder.

22. An electrical connector comprising:

a dielectric housing having a terminal-receiving bottom wall, and top and side walls, said walls defining a forward free housing end, a rearward cord-receiving housing end having a cord entrance opening formed therein, and a cord-receiving cavity, said cord-receiving cavity having a forward conductor-receiving portion, and terminal-receiving slots formed in the housing bottom wall communicating with said conductor-receiving portion of said cord-receiving cavity;

a plurality of insulated conductors enclosed within an outer jacket, an end portion of said cord having said outer jacket removed therefrom to expose end regions of said insulated conductors;

a load block having a plurality of parallel apertures formed therein in a linear array, each aperture receiving an end region of a respective insulated conductor, said apertures being mutually spaced from each other by a distance equal to the distance between the terminal-receiving slots formed in said housing, said load block with said end regions of respective conductors received in respective apertures thereof being inserted in said forward conductor-receiving portion of said cord-receiving cavity so that said respective conductors are aligned with respective terminal-receiving slots; and a row of contact terminals received in respective slots in terminating engagement with respective conductors.

23. A cord assembly terminated by modular plug connector, the modular plug connector including a dielectric housing having a terminal-receiving bottom wall, and top and side walls, said walls defining a forward free housing end, a rearward cord-receiving housing end having a cord entrance opening formed therein, and a cord-receiving cavity, said cord-receiving cavity having a forward conductor-receiving portion, and terminal-receiving slots formed in the housing bottom wall communicating with said conductor-receiving portion of said cord-receiving cavity, said terminated cord assembly further comprising:

a plurality of insulated conductors enclosed within an outer jacket, an end portion of said cord having said outer jacket removed therefrom to expose end regions of said insulated conductors; and a load block having a plurality of means for holding said end regions of said conductors in mutually parallel relationship and being mutually spaced from each other by a distance equal to the distance between the terminal-receiving slots formed in said housing, and wherein said load block holds said conductor end regions so that terminals inserted in said terminal-receiving slots engage said end regions of said conductors which are held by the load block.

* * * * *